US006643954B2

(12) United States Patent
Voswinkel

(10) Patent No.: US 6,643,954 B2
(45) Date of Patent: Nov. 11, 2003

(54) DEVICE FOR ACTIVATING A LACE-UP TRACTION DEVICE FOR A SHOE

(76) Inventor: Egon Voswinkel, Ulrichstr. 3a, D-86462 Langweid/Stettenhofen (DE)

( * ) Notice: Subject to any disclaimer, the term of this patent is extended or adjusted under 35 U.S.C. 154(b) by 0 days.

(21) Appl. No.: 10/175,290

(22) Filed: Jun. 20, 2002

(65) Prior Publication Data

US 2003/0009917 A1 Jan. 16, 2003

(30) Foreign Application Priority Data

Jul. 10, 2001 (DE) ..... 101 33 489

(51) Int. Cl.[7] ..... A43C 11/12
(52) U.S. Cl. ..... 36/50.1; 36/138
(58) Field of Search ..... 36/50.1, 50.5, 36/138

(56) References Cited

U.S. PATENT DOCUMENTS 5,983,530 A * 11/1999 Chou ..... 36/50.1
6,427,361 B1 * 8/2002 Chou ..... 36/50.1
6,467,194 B1 * 10/2002 Johnson ..... 36/50.1

* cited by examiner

*Primary Examiner*—Ted Kavanaugh
(74) *Attorney, Agent, or Firm*—Jones, Tullar & Cooper, P.C.

(57) ABSTRACT

In a device for activating a lace-up traction device for a shoe (1), comprising a slider (22) and a hingeably held tension lever (9) which can be pushed down when the shoe (1) is put on, said tension lever (9) in the pushed-down state being lockable to the slider (22) and being unlockable by pushing the slider (22) forward; said slider (22) comprising a guide (37) for a rocker (39), which rocker (39) elsewhere is guided in a further longitudinal guide (26) and which rocker (39) is pre-tensioned in the direction of hingeing forward and upward by a spring arrangement (7), a simple and clear design as well as good functional safety are achieved in that the guide (37) comprises two branches **(37*a*, 37*b*) arranged at an angle in relation to each other; in that the slider (22) comprises a stopping face (28), and the rocker (39) comprises an associated engagement element (41) by which the slider (22) can be moved to the rear, into the rear snap-in position; and in that the slider (22) comprises a guide (30), while the rocker (39) comprises an associated engagement element (41) by which the engagement element (41) of the rocker (39), which engagement element engages the guide (37), can be made to move to a position which is suitable for moving into the front branch (37*a*) of the guide (37)**.

8 Claims, 5 Drawing Sheets

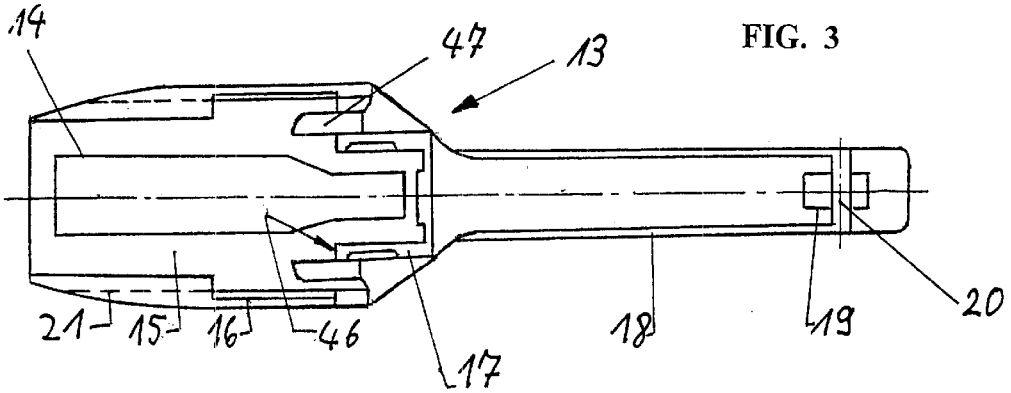
FIG. 3
FIG. 4
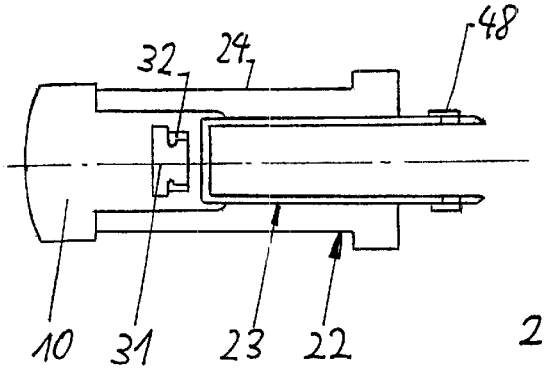
FIG. 5
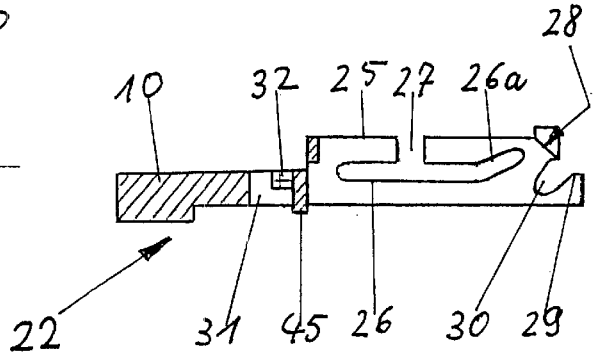
FIG. 7
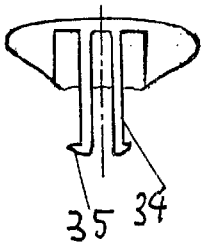
FIG. 6
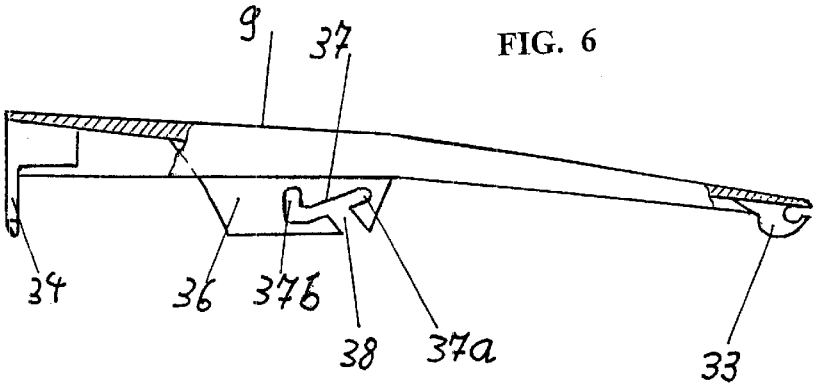
FIG. 8
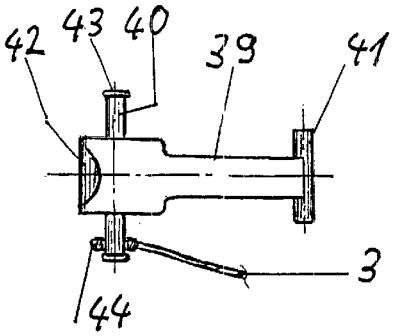
FIG. 9
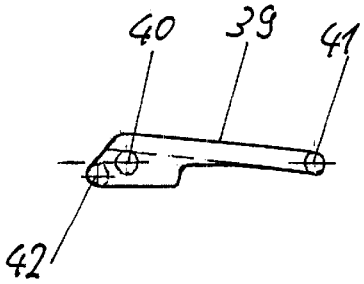

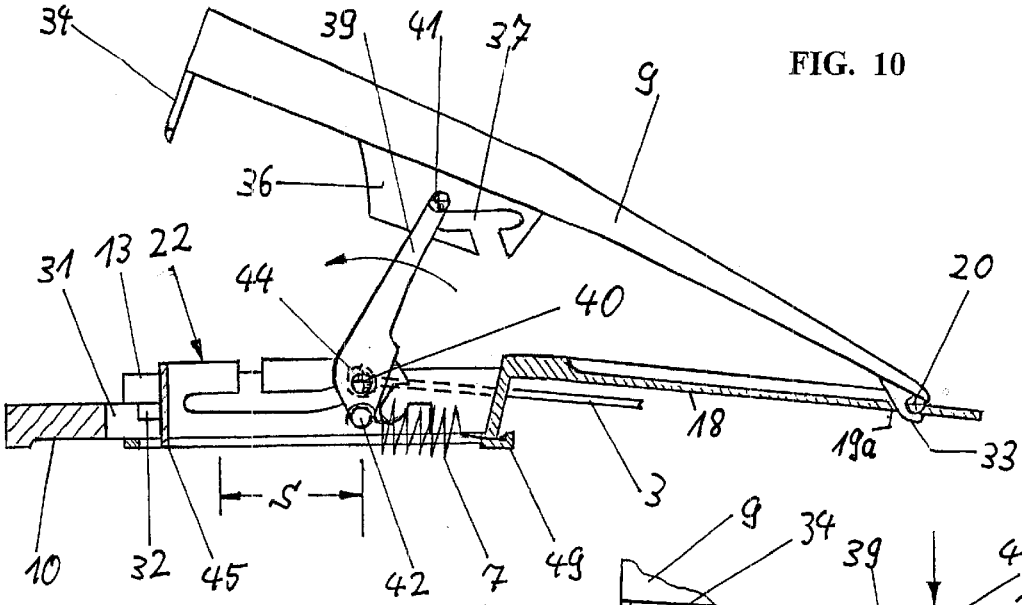
FIG. 10
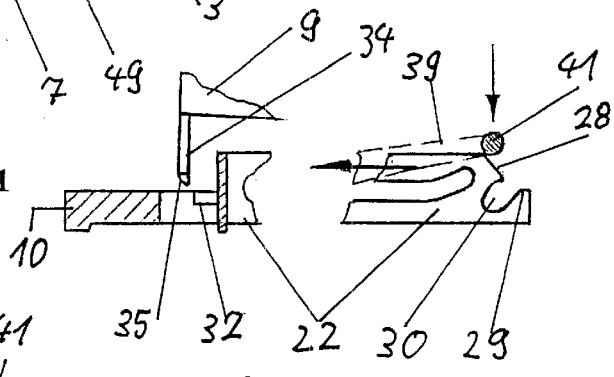
FIG. 11
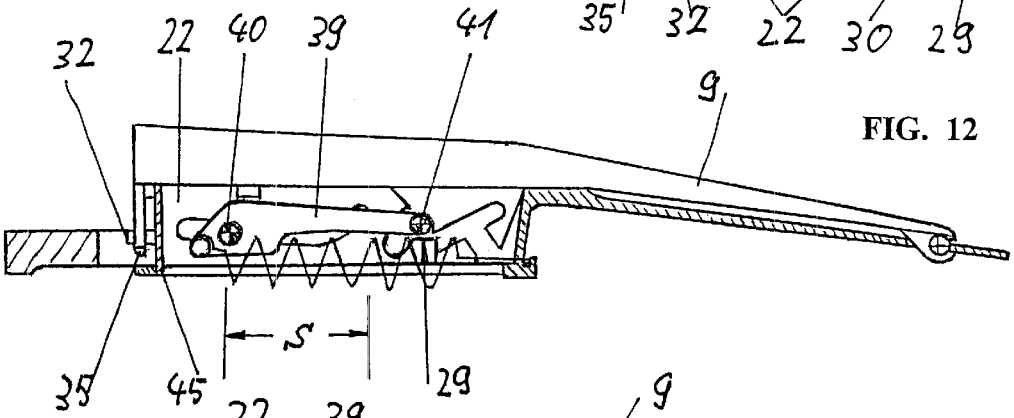
FIG. 12
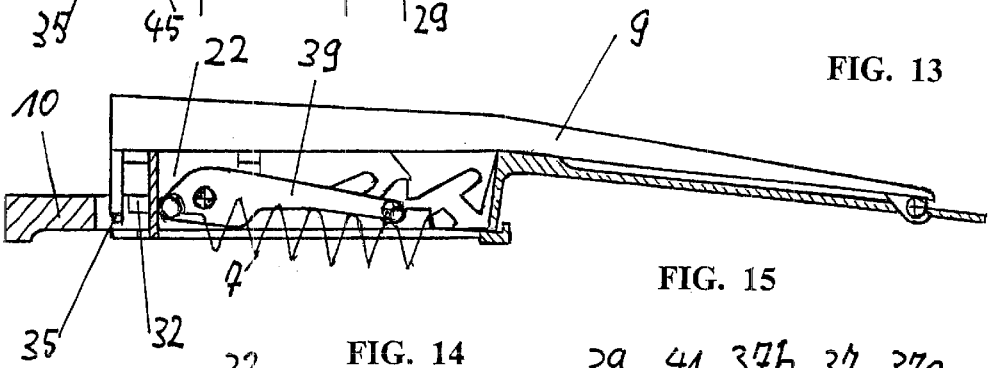
FIG. 13
FIG. 15
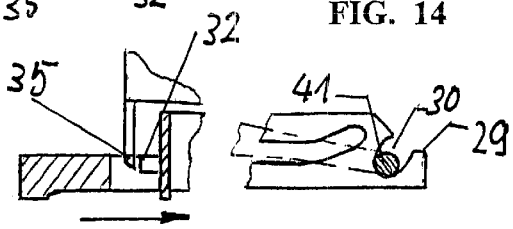
FIG. 14
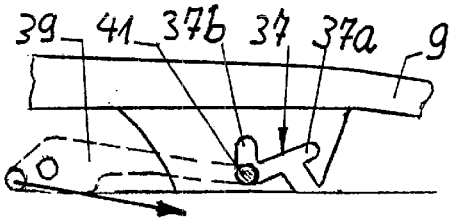

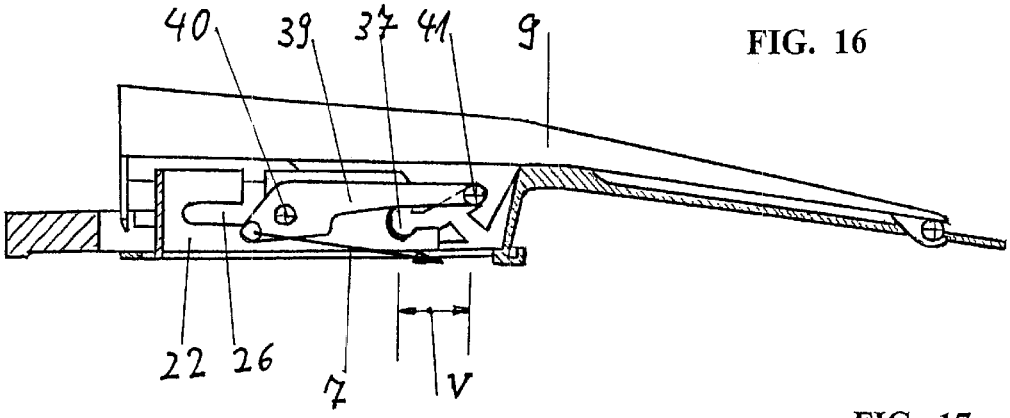
FIG. 16
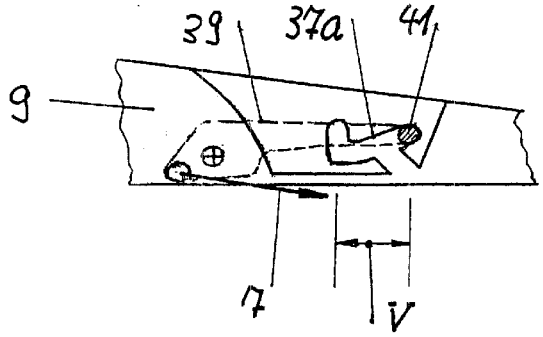
FIG. 17
FIG. 18
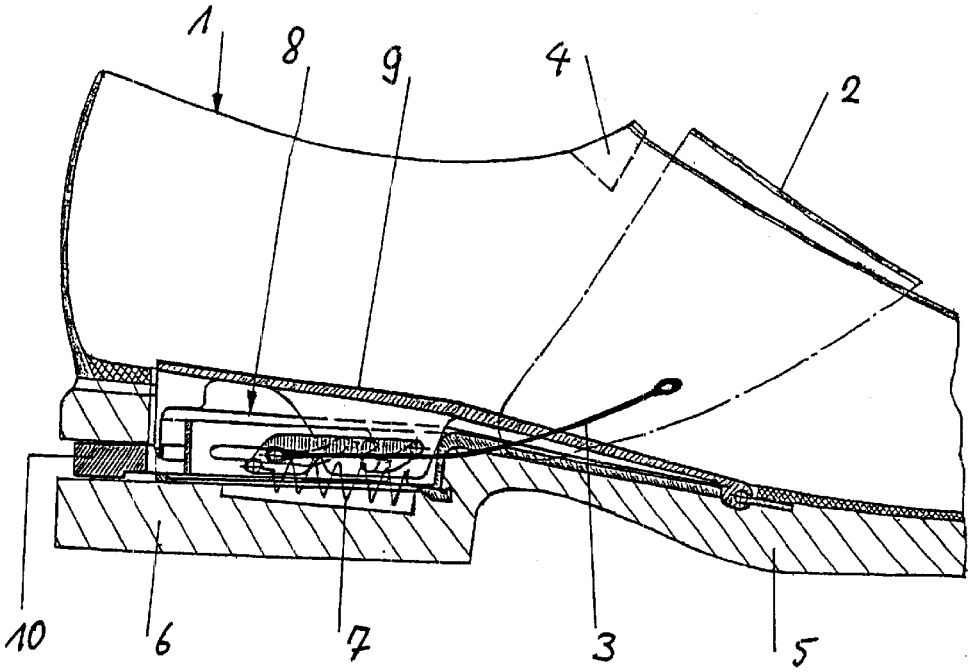

DEVICE FOR ACTIVATING A LACE-UP TRACTION DEVICE FOR A SHOE

BACKGROUND OF THE INVENTION

The invention relates to a device for activating a lace-up traction device for a shoe, comprising a housing arranged in the rear region of the substructure of the shoe, with a slider comprising a rearward projecting activation projecion being accommodated in said housing so as to be slidable in longitudinal direction of the shoe; said device further comprising a tension lever encompassing the housing, said tension lever being held at its front end so that he can hinge up or down and said lever being able to be pushed down by the heel of the foot when the shoe is put on; with said tension lever in its pushed down state being lockable with the slider which has been brought to a rearward snap-in position, and unlockable by moving the slider forward; and with the underside of said tension lever comprising a guide for the top end region of a rocker whose bottom end region acts together with lace-up traction elements and is guided in a longitudinal guide, which rocker being pre-tensioned in the direction of hingeing forward and upward by means of a spring arrangement.

A device of this type is known from DE 36 29 292 C2. This printed publication discloses two embodiments with single stage and dual stage opening respectively, of the lace-up traction device. To form a rocker, the arrangement with dual-stage opening of the lace-up traction device provides a lever arrangement comprising two levers linked to each other and to the tension lever so as to be articulated, with said lever arrangement in the tensioned position being stretched out, and with said lever arrangement being pulled by the tension spring towards an end stop which is movable by means of a slider. At some distance behind the movable end stop there is a fixed end stop. During unlocking of the movable end stop, said lever arrangement is pushed forward up to the first end stop so as to carry out the first stage of the opening movement. Subsequently, by means of a second spring, the lever arrangement is moved to a buckled position, so as to carry out the second stage of the opening movement. This known arrangement is very expensive and not sufficiently reliable in its function.

SUMMARY OF THE PRESENT INVENTION

Based on this, it is the object of the present invention to improve a device of the type mentioned in the introduction, using simple and economical means, to the extent that there is no longer a two-stage lever arrangement and a second spring, while nevertheless a two-stage opening action of the lace-up traction device is achieved.

According to the invention, this object is met in that the guide of the tension lever, said guide being associated with the upper end region of the rocker which is a single-part lever, comprises two branches arranged at an angle in relation to each other; that the slider comprises a stopping face, and the rocker comprises an engagement element which when the tension lever is pushed down engages said stopping face, which results in the slider being slidable to the rear, into the rear snap-in position associated with the snap-in device of the tension lever; and that the slider comprises a link-type guide means, which guide means is open towards the front, while the rocker comprises an engagement element which, by moving forward the slider, can be made to engage with said guide means when the tension lever is pushed down; with said action resulting in the engagement element of the rocker, which engagement element engages the angled guide of the tension lever, to be able to be moved to a position which is suitable for moving into the front branch of the angled guide of the tension lever.

These measures advantageously provide a simple and compact design with a single-part rocker and a spring, and due to the comparatively low number of components, ensure easy production and installation, as well as good functional safety. Thus, the device according to the invention completely overcomes the disadvantages of the generic state of the art.

Advantageous embodiments and useful improvements of the overall measures are provided in the subordinate claims. Thus, the arrangement can be such that the engagement element of the rocker, said engagement element engaging the angled guide of the tension lever, can also be made to engage the stopping face and the connecting member of the guide of the slider, so that there are no longer any additional engagement elements. This results in a particularly simple and compact design.

A further advantageous measure can consist of the slider comprising lateral walls comprising slots which form the longitudinal guide associated with the lower end region of the rocker; with lateral pins of the rocker leading through said slots, with a lace-up traction element being able to be attached to said pins. Accommodating the rocker on the movable slider, which slider is preferably provided in the housing comprising lateral walls, results in particularly good functional safety and facilitates inserting the device according to the invention in a shoe.

It is advantageous if the housing comprises a projecting tongue on which the tension lever is hingeably held by means of a snap-in claw. Arranging the tension lever on the housing makes it possible, in a simple way, to achieve good accuracy and functional safety while at the same time providing a unit which can be completely pre-assembled. The device according to the invention can thus be inserted in the associated shoe as a completely pre-assembled unit.

Further advantageous embodiments and suitable improvements of the encompassing measures are provided in the remaining subordinate claims and are set out in the following exemplary description and explained in more detail by means of the drawing.

BRIEF DESCRIPTION OF THE DRAWINGS

FIG. 3 is a top view of the housing of the device according to the invention;

FIG. 4 is a top view of the slider of the device according to the invention;

FIG. 5 is a longitudinal section of the slider according to FIG. 4;

FIG. 6 is a lateral view of the tension lever of the device according to the invention, in partial section view;

FIG. 7 is a rear face view of the tension lever according to FIG. 6;

FIG. 8 is a top view of the rocker of the device according to the invention;

FIG. 9 is a lateral view of the rocker according to FIG. 8

FIG. 10 is a longitudinal section of the preassembled device according to the invention, in an open position which corresponds to that of FIG. 2;

FIG. 11 is a diagrammatic representation of the engagement between the slider and the associated engagement element of the rocker, shortly before reaching the completely closed position;

FIG. 12 shows the arrangement according to FIG. 10 in its closed state;

FIG. 13 shows the arrangement according to FIG. 12 with the slider in the forward position;

FIG. 14 is a diagrammatic representation of the engagement between the connecting member of the guide located on the slider, and the associated engagement element of the rocker, in an arrangement according to FIG. 13;

FIG. 15 is a diagrammatic representation of the engagement between the engagement element of the rocker and the associated guide located on the tension lever, in an arrangement according to FIG. 13;

FIG. 16 shows the arrangement according to FIG. 13 after the rocker has moved into the forward position;

FIG. 17 is a diagrammatic representation of the engagement of the upper engagement element of the rocker with the guide located on the tension lever, in the arrangement according to FIG. 16;

FIG. 18 shows the shoe according to FIGS. 1 and 2 in the situation which forms the basis of FIGS. 16 and 17, with the lace-up traction device being partially loosened;

DETAILED DESCRIPTION OF WORKING EMBODIMENT OF THE INVENTION

Figure 1:
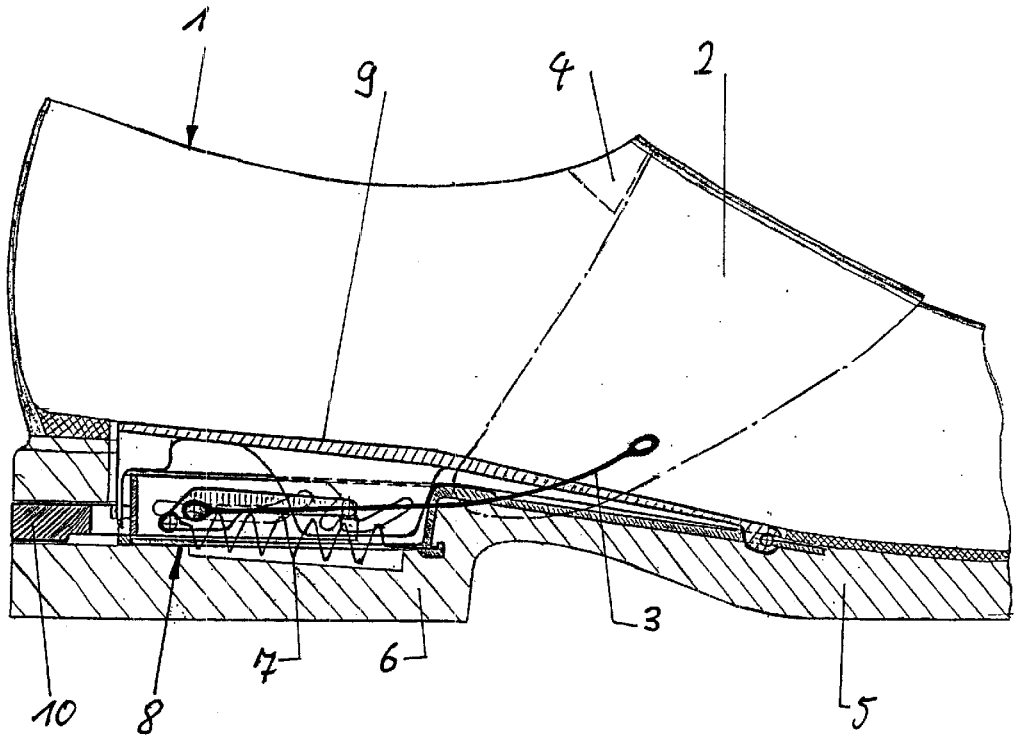
FIG. 1 is a longitudinal section for a shoe comprising a device according to the invention in its closed state.
Figure 2:
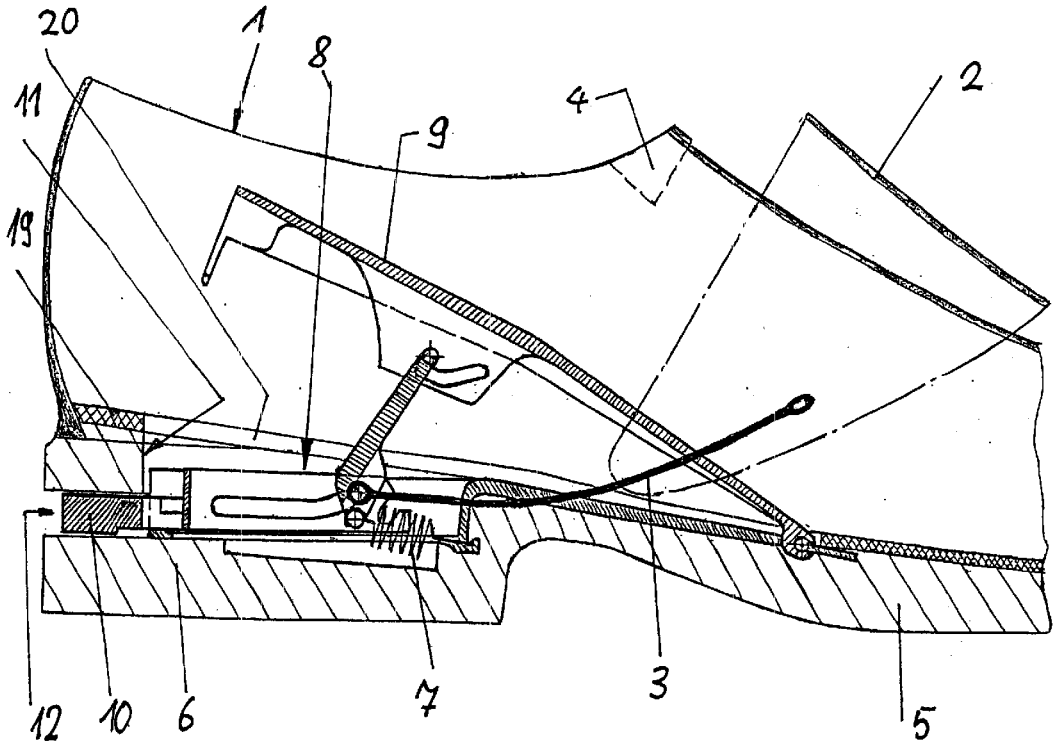
FIG. 2 shows the arrangement according to FIG. 1 with the lace-up traction device entirely loosened.

The shoe 1, which forms the basis of FIGS. 1 and 2, comprises a strap 2 encompassing the instep region which comprises an extension slit. A lace-up traction element 3 acts on each of the lateral ends of the strap 2. These can be plastic ribbons which are comparatively rigid under pressure, such plastic ribbons being able to act as push-and-pull elements. The lace-up traction elements 3 can comprise hooks which can be hooked into eyelets comprised in the strap. Advantageously, each side of the strap 2 comprises several eyelets. This makes it possible to adjust the desired tension of the entire lace-up traction device formed by the strap 2 and the lateral lace-up traction elements 3.

The lace-up traction elements 3 act on the underside of the strap 2, while on the shoe being arranged in a respectively associated channel. The lace-up traction elements 3 are therefore not visible from the outside. By moving the lace-up traction elements 3, the strap 2 can be moved from the tensioned position which forms the basis of FIG. 1, in which tensioned position the shoe 1 is held closed, to the raised position which forms the basis of FIG. 2, in which raised position the extension slit of the shoe 1 can open up and the shoe can therefore be put on or taken off. In the tensioned position, the strap 2 comes to rest against an associated end stop 4 provided on the shoe by a sewn-on part etc., said end stop 4 ensuring that the strap 2 maintains a precise position in the tensioned position.

A mechanism 8 incorporated in the rear region of the substructure of the shoe 1, said region being formed by the sole 5 and the heel 6, said mechanism 8 comprising a tension spring 7, is provided for activating the lace-up traction element 3. When the shoe is being put on, said mechanism 8 can be tensioned by means of a tension lever 9 which can be pushed down by the heel of the foot and can be triggered by a press element 10 which can be activated from the outside. Said press element 10 is located in a channel 12, leading to a chamber 11 contained in the substructure of the shoe and associated with the mechanism 8. Said channel 12, which exits at the rear of the heel 6, is open in this position in the embodiment shown, but it could also be covered up by a membrane or the like.

FIGS. 3 to 9 show the details of the mechanism 8 which details are explained below.

The mechanism 8 comprises a housing 13 which forms the basis of FIG. 3 and which in practical application serves as an installation carrier, said mechanism 8 being able to be inserted into the chamber 11. Said housing 13 comprises a floor 15 comprising a recess 14 in the manner of an elongated hole, with two lateral walls 16 delimiting said floor 15, with said two lateral walls 16 being connected by a U-shaped bridge, from the top of which a tongue 18 projects forward at a slight downward angle, as shown in FIGS. 1 and 2. The chamber 11 accordingly comprises a projection associated with the tongue 18. As is shown in FIGS. 1 and 2, the insole 19 of the shoe 1 comprises a section 20 associated with the chamber 11 including the projection. In the region of its front end, the tongue 18 comprises a window 19 which is traversed by an axle 20 on which the already mentioned tension lever 9, which forms the basis of FIGS. 6 and 7, can be held.

In the region of the lateral walls 16 of the housing 13, grooves which form a longitudinal guide 21 are provided, in which grooves a slider 22, shown in FIGS. 4 and 5, can be accommodated. As is most clearly shown in FIG. 4, the slider 22 comprises an approximately U-shaped frame 23 from which a projection which forms the already mentioned press element 10 projects rearward, with said U-shaped frame 23 comprising lateral guide beads 24 which can be inserted into the associated longitudinal guide 21 on the housing. End stops and counter end stops are provided on the slider 22 and on the housing 13, so as to delimit slider movement.

As is shown in FIG. 5, each of the lateral walls 25 of the U-shaped frame 23 comprises a guide slot 26 to form a longitudinal guide, with the front section **26*a* of said guide slot 26 being slightly upwardly inclined. The remaining guide slot is approximately parallel to the guide. In this area, an insertion slot 27 which is open towards the top is provided. In the region of the front end of the side walls 25, in the region of the upper corner, said side walls 25 comprise a stopping face 28 which is inclined upward towards the rear, and a support surface 29 located underneath said stopping face 28, said support surface 29 being approximately level in the embodiment shown. Located between the stopping face 28 and the support surface 29, is a linke-type guide means 30, formed by an indentation which is open towards the front. The upper delimitation of said guide means 30 correspondingly adjoins the stopping face 28, while the lower delimitation of said guide means 30 adjoins the support surface 29**.

In the region behind the rear bridge of the U-shaped frame 23, the projection which forms the press element 10, comprises an opening 31 whose lateral flanks comprise snap-in teeth 32 which extend only across approximately the front half of the respectively associated lateral flank. Accordingly, the rear half of the opening 31 does not comprise any snap-in teeth. The snap-in teeth 32 are used to lock the tension lever 9 in the tensioned position which forms the basis of FIG. 1.

The tension lever 9 which is shown in more detail in FIGS. 6 and 7, in the region of its front end comprises a snap-in claw 33 which can be locked onto the axle 20 of the tongue 19 of the housing 13, so as to provide hingeable attachment of the tension lever 9. In the region of its rear extremity, the tension lever 9 comprises two downward projecting legs 34 of the spring, said legs 34 comprising laterally protruding snap-in teeth 35. This is most clearly shown in FIG. 7. In this way, the tension lever 9 can be made to engage the snap-in teeth 32 on the slider 22, as has already been indicated above. On its underside, the tension lever 9 comprises two parallel straps 36 which project downward, said straps comprising guide slots 37. These guide slots 37 are angled in a V-shape, thus forming two forward or rearward inclined branches 37*a*, 37*b*. The rear branch 37*b* is arranged more steeply than the front branch 37*a* which only has a slight incline from the rear to the front. In the region of the front branch 37*a*, the guide slots 37 comprise an insertion slot 38 which is open towards the bottom.

The tension lever 9 is connected to the slider 22 by means of a rocker 39 which forms the basis of FIGS. 8 and 9. To this effect, the upper end region of the rocker 39 is made to engage the guide slots 37 on the tension lever, while the end region of said rocker 39 is made to engage the guide slots 26 on the slide. To this effect, the lower end region of the rocker 39 is inserted between the lateral walls 25 on the slide, while the upper end region of said rocker 39 is inserted between the straps 36 on the tension lever. At its lower end region, said rocker 39 comprises laterally projecting guide pins 40, associated with the guide slots 26 of the slide, while at its upper end region, shown on the right in FIGS. 8, 9, said rocker 39 comprises laterally projecting guide pins 41 associated with the guide slots 37 on the tension lever. The guide pins 40, 41 are inserted into the associated guide slots 26 and 37 respectively, by way of the insertion slots 27 and 38 respectively. The pin diameter approximately corresponds to the width of the slot. In the region of the base of the pin, the width of the rocker approximately corresponds to the clearance of the lateral walls 25 on the slider, or of the straps 36 on the tension lever.

On the lower end of the rocker 39, an eyelet 42 is provided towards the side which in relation to the lower guide pins 40 faces away from the upper guide pins 41, with said eyelet 42 being located below a connection line between the lower and the upper guide pins 40, 41. The above-mentioned tension spring 7 can be hooked into said eyelet 42. On their outer margin, the lower guide pins 40 comprise a narrow end flange 43. In this way, the lace-up traction elements 3 which can be attached to the section of the lower guide pins 40, which section projects beyond the lateral walls 25 of the slide, are secured. As indicated in FIG. 8 at the bottom, said lace-up traction elements 3 can comprise a ring 44 which can be stretched sufficiently so as to be able to be moved over the associated end flange 43.

FIG. 10 shows the device according to the invention in its installed state. In order to be held so as to be hingeable, the snap-in claw 33 of tension lever 9 is made to engage the axle 20 of the tongue 18 of the housing 13. In this arrangement, the rear edge of the window 19 forms an edge of the end stop 19*a* which acts in unison with the rear of the claw 33. Consequently, said claw 33 can only be latched or unlatched in an approximately perpendicular position, but it cannot be latched or unlatched in the angular range which corresponds to its operating range. The rear of the claw 33 is practically concentrically arranged in relation to its snap-in recess. The guide beads 24 of the slider 22 are made to engage the guide grooves 21 on the housing. In order to form end stops, a lower projection 45 of the rear bridge of the U-shaped frame 23 of the slider 22, said projection 45 projecting into the elongated hole 14, interacts with the rear edge of the elongated hole; while the front end of the lateral walls 25 of the U-shaped frame of the slider 22 interacts with end stop faces 46, shown in FIG. 3, of the housing 13, said end stop faces 46 extending transversely to the lateral flanks 25.

The length of the tension lever 9 is such that the snap-in teeth 35 of the legs 34 of the spring provided at the rear end, in the rear end-stop position of the slider 22 can be made to engage the snap-in teeth 32 on the slider; and that in the front end-stop position of the slider 22, the snap-in teeth 35 on the tension lever are thus not engaged, but are in the rear half of the opening 31 of the slider, which rear half does not comprise any snap-in teeth 35. When the slider 22 is in its front end-stop position, the front ends of the lateral walls 25 on the slider 22 are flanked by associated support cheeks 47 on the housing; said support cheeks 47 being shown in FIG. 3. The lateral walls 25 can comprise enlarged sections 48 associated with the support cheeks 47; said enlarged sections 48 being indicated in FIG. 4.

The tension lever 9 and the slider 22 are linked together by the rocker 39. To this effect, as already mentioned above, the lower guide pins 40 reach through the guide slots 26 on the slider, while the upper guide pins 41 reach through the guide slots 37 on the tension lever 9. The arrangement of the guide slots 26, 37 is such that even in the stand-by position of the raised tension lever 9, which position forms the basis of FIG. 10, the rocker 39 is inclined forward. In each case, the ring 44 of the associated lace-up traction element 3 is accommodated on the end regions of the lower guide pins 40, said end regions projecting beyond the lateral walls 25 of the slider 22. The rear end of the tension spring 7 is hooked into the eyelet 42 of the rocker 39. The front end of said tension spring 7 is hooked into a hook 49 arranged in the region of the front transverse bridge of the housing 13.

Because of the position of the eyelet 42, as a result of the force exerted by the tension spring 7 (as indicated by a curved arrow), the rocker 39 is hinged up on an axle formed by the lower guide pins 40, and is pulled forward. In this way the lower guide pins come to rest against the front end of the associated guide slots 26, while the upper guide pins 41 come to rest against the rear end of the associated guide slots 37. In this way, the tension force of the spring 7 is also transferred to the slider 22 which accordingly is moved forward and brought into its front end-stop position in which, as already mentioned above, the front ends of the lateral walls 25 on the slider, rest against the end stop faces 46 on the housing. As a result of the hingeing movement of the rocker 39, the rear end of the tension lever 9 hinges upward, so that the standby position results which forms the basis of FIG. 10.

This position of the mechanism 8 is the initial position when the respective shoe is to be worn. When the shoe is being put on or when the foot is pushed into the shoe, the heel of the foot which is inserted into the shoe, pushes down the tension lever 9. Initially, as already mentioned above, the rear legs 34 of the spring engage the rear region of the opening 31 on the slider, said rear region comprising no snap-in teeth, so that no locking takes place, as is indicated in FIG. 11 on the left. During this movement of the tension lever 9, the rocker 39 is moved against the direction of the arrow shown in FIG. 10. During this process, the lower guide pins 40 move to the rear, along the longitudinal guide formed by the guide slots 26. This is facilitated by the above-mentioned upward incline of the front region 26*a* of the longitudinal guide 26. As a result of this movement of the lower region of the rocker 39, the spring 7, hooked into said rocker 39, is tensioned.

Shortly before the mechanism reaches the pre-tensioned end position which forms the basis of FIG. 12, in which end position the rocker 39 is completely countersunk in the slider 22, the end regions of the upper guide pins 41, which end regions project beyond the lateral straps 36 of the tension lever 9, as indicated on the right in FIG. 11, come to rest against the inclined stopping face 28 on the slider. As a result of this, the slider 22 is moved from the front end-stop position where it has been until this point, back to the rear end-stop position. As a result of this movement, there is mutual engagement between the snap-in teeth 32 on the slider 22 and the snap-in teeth 35 on the tension lever, as indicated in FIG. 12. As a result of this snap-in engagement, the tension lever 9 and with it the entire mechanism 8, are locked against the tension force of the spring 7. In this arrangement, the rocker 39 is in its lower end position. As further shown in FIG. 12, the lateral end regions of the front guide pins 41 rest against the support surface 29 provided in the region of the front ends of the lateral walls 25 of the slider 22.

When the tension lever 9 is pushed down, the lower guide pins 40 travel the distance s which corresponds to the difference between the positions of the lower guide pins 40 in FIGS. 10 and 12. The lace-up traction elements 3 attached to the lower guide pins 40 are pulled by the same distance s. In this way, the strap 2 attached to said lace-up traction elements 3 is moved from the loosened position which forms the basis of FIG. 2, to the tensioned position which forms the basis of FIG. 1, in which tensioned position the respective shoe 1 is firmly seated.

In order to remove the shoe 1, the lace-up traction device is loosened. To this effect, the press element 10 is moved to the position which forms the basis of FIG. 2. As is shown in FIGS. 13 and 14, consequently the attached slider 22 is also moved forward sufficiently far for the snap-in teeth 35 on the tension lever and the snap-in teeth 32 on the slider to disengage, thus unlocking the mechanism. At the same time, the lateral end regions of the upper guide pins 41 move away from the support surface 29, into the adjacent guide means 30, which guide means 30, located on the slider 22, is inclined downwards towards the rear, as is further shown on the right in FIG. 14. As a result of forward movement of the slider 22, the upper guide pins 41 of the rocker 39, which guide pins 41 are simultaneously engaged with the rear branch 37*b* of the guide 37 on the tension lever, are thus moved downward. The depth of the guide means 30 is such that the upper guide pins 41 move to the transition region between the rearward inclined rear branch 37*b* and the forward inclined front branch 37*a* of the guide 37 on the tension lever, as is indicated in FIG. 15. As soon as this position is reached, the upper guide pins 41 of the rocker 39 can move into the front branch 37*a* of the guide on the tension lever 9. During this action, the spring force, which in FIG. 15 is indicated by an arrow, said spring force acting on the rocker 39, pushes said rocker 39 forward until the guide pins 41 come to rest against the front end of the front branch 37*a* of the guide 37 on the tension lever 9. This position forms the basis of FIGS. 16 to 18.

The distance v of forward movement, covered in this way, practically corresponds to the horizontal projection of the front branch 37*a* of the guide 37 on the tension lever 9. Advantageously, this forward movement of the rocker 39, and thus also of the lace-up traction elements 3 attached to the rear guide pins 40 of the rocker 39, is already possible when the tension lever 9 is still in its pushed-down position. Due to this forward movement, in a first stage, the lace-up traction device is loosened while the tension lever 9 is still pushed down, with the strap 2 being moved into an intermediate position between the positions of FIGS. 1 and 2. This intermediate position is shown in FIG. 18. In this way the heel of the foot achieves a certain degree of freedom of movement and can easily be withdrawn from the shoe 1.

Figure 19:
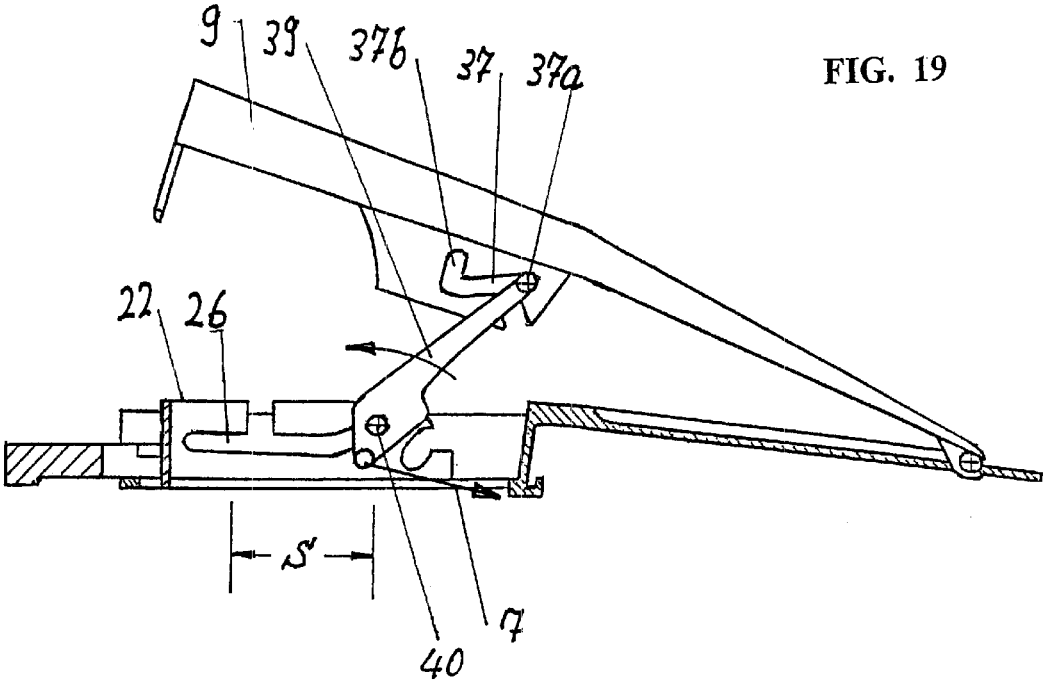
FIG. 19 shows the device according to the invention in the situation which follows after the situation which forms the basis of FIG. 16, said position occurring before the position according to FIG. 10.

The tension lever 9 is hinged upward by the rocker 39 upon which the tension spring 7 (which in FIG. 19 is only indicated by a force arrow) applies a force of forward movement and a torque, to the same extent as the heel of the foot is withdrawn from the shoe 1. At the same time, the lower end region of the rocker 39 is moved forward by the spring force, until the lower guide pins 40, which engage the guide slots 26, which form the longitudinal guide on the slider 22, come to rest against the front end of the longitudinal guide on the slider 22. In this process, the lower guide pins 40 and thus also the lace-up traction elements 3 attached thereto, travel forward by the distance s. As a result of this, the strap 2 of the lace-up traction device moves to the entirely untensioned position which forms the basis of FIG. 2. Opening the lace-up traction device thus takes place in two stages: in the first stage the distance v is covered, while in the second stage the distance s is covered.

When the position which forms the basis of FIG. 19 has been reached, and the heel has completely released the tension lever 9, the rocker 39 is hinged back further as a result of the moment exerted by the tension spring 7, i.e. counterclockwise in FIG. 19. During this process, the upper guide pins 41 in the front branch 37*a* of the guide 37 on the tension lever 9, slide rearward before moving into the rear branch 37*b*. In this way, the initial position, which forms the basis of FIGS. 2 and 10, is reached.

Figure 20:
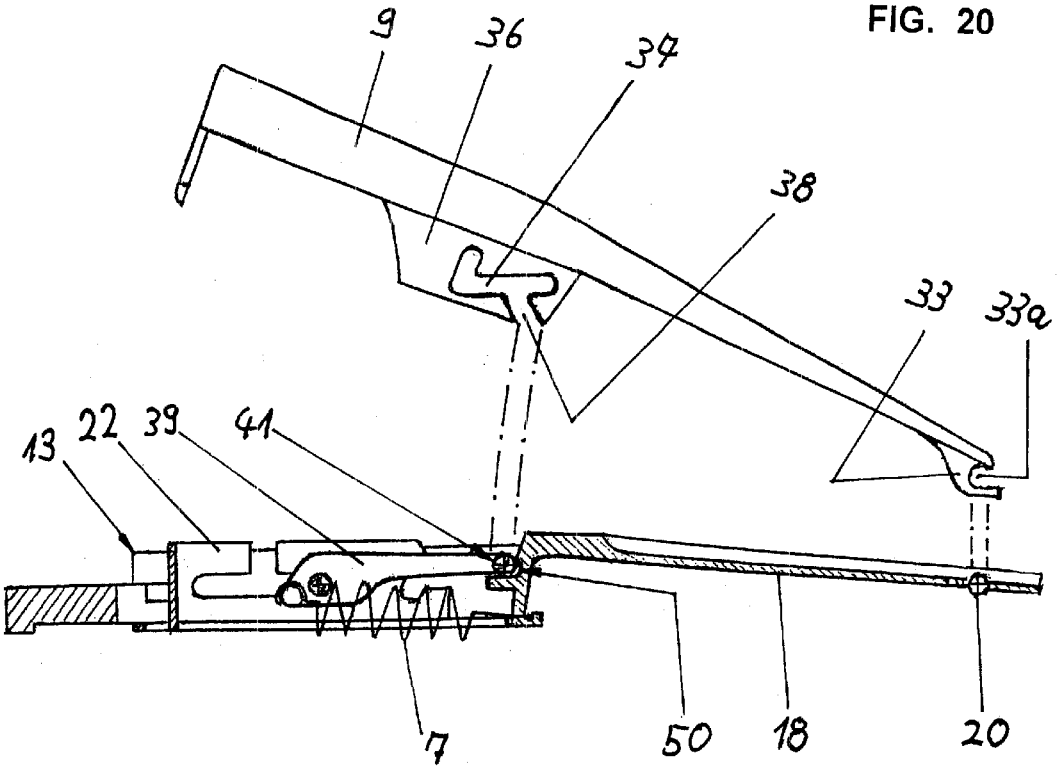
FIG. 20 is a longitudinal section of the device according to the invention, in the assembly state, with the tension lever able to be installed subsequently.

When the device according to the invention is installed in a shoe, it is advantageous if the tension lever 9 is not preassembled, so as not to obscure the view. It is advantageous if the other components are preassembled. Accordingly, as shown in FIG. 20, the slider 22 as well as the rocker 39 and the tension spring 7 in a housing 13 which can be inserted into a shoe, are already preassembled. Only the snap-in claw 33 of the tension lever 9 is not hooked into the associated axle 20, as is indicated in FIG. 20 by showing the tension lever 9 at some distance from the housing 13.

In order to facilitate subsequent installation of the tension lever 9 and its linkage to the rocker 39,as is further shown in FIG. 20, the housing 13, in the region of the inside of the front transverse wall carrying the tongue 18, comprises a snap-in notch 50. In its pushed-down state, countersunk in the housing 13, the front end region of the rocker 39, i.e. its upper guide pins 41, can be made to engage said snap-in notch 50. In order to be able to make the rocker 39 engage the snap-in notch 50 in this way, said rocker 39 must be pushed back against the force of the tension spring 7 acting upon said rocker 39. Thus, the rocker 39 is held by the force exerted by the tension spring 7 engaging the snap-in notch 50, thus being held in the position in which it is countersunk in the housing 13.

The distance between the snap-in notch 50 and the axle 20 associated with the tension lever 9, said axle 20 being arranged on the tongue 18 of the housing 13, corresponds to the distance between the snap-in recess 33*a* of the snap-in claw 33 of the tension lever 9, said snap-in recess 33*a* being associated with the axle 20, and the lower end of the inclined insertion slot 38 of the guide slot 37 provided in the region of the downward projecting straps 36 of the tension lever 9. When the snap-in claw 33 of the tension lever 9 is made to engage the axle 20 and is then hinged to the housing 13, due to the above-mentioned spacing, the guide pins 41 of the rocker 39, in the snap-in position which forms the basis of FIG. 20, moves into the inclined insertion slot 38, as is indicated in dot-dash lines in FIG. 2. Due to the incline of the insertion slot 38, the rocker 39 is pushed back somewhat and is thus made to disengage the snap-in notch 50. As soon as this is the case, the front end of the rocker 39 is hinged upward by the tension spring 7 acting on said rocker 39. As a result of this, the upper guide pins 41 of the rocker 39 automatically move into the associated guide slot 37. In this way the situation which forms the basis of FIG. 10 is reached and the tension lever 9 is properly linked to the slider 22 by way of the rocker 39.

So as to ensure that the tension lever 9 reliably causes the rocker 39 to disengage the snap-in notch 50, the depth of the snap-in recess 50 is somewhat shallower than the rearward displacement of the rocker 39, caused by the incline in the insertion slot 38 when the guide pins 31 enter the lower end region of the insertion slot 38, said end region approximately corresponding to the diameter of the guide pins 41. This ensures that when the subsequently installed tension lever 9 is pushed down, the rocker 39 automatically engages said tension lever 9. This facilitates subsequent installation of the tension lever 9, thus simplifying installation of the housing 13 in a recess in the shoe, with the tension lever 9 removed.

What is claimed is:

1. A device for activating a lace-up traction device for a shoe, comprising a housing arranged in the rear region of the substructure of the shoe, with a slider comprising a rearward projecting activation projection being accommodated in said housing so as to be slidable in longitudinal direction of the shoe; said device further comprising a tension lever encompassing the housing, said tension lever being held at its front end so that he can hinge up or down and said lever being able to be pushed down by the heel of the foot when the shoe is put on; with said tension lever in its pushed down state being lockable with the slider which has been brought to a rearward snap-in position, and unlockable by moving the slider forward; and with the underside of said tension lever comprising a guide for the top end region of a rocker whose bottom end region acts together with lace-up traction elements and is guided in a longitudinal guide, which rocker being pre-tensioned in the direction of hinging forward and upward by means of a spring arrangement, whereby the guide of the tension lever, said guide being associated with the upper end region of the rocker which is a single-part lever, comprises two branches arranged at an angle in relation to each other; whereby the slider comprises a stopping face, and the rocker comprises an engagement element which when the tension lever is pushed down engages said stopping face, which results in the slider being slidable to the rear, into the rear snap-in position associated with the snap-in device of the tension lever; and whereby the slider comprises a link-type guide means, which guide means is open towards the front, while the rocker comprises an engagement element which, by moving forward the slider, can be made to engage with said guide means when the tension lever is pushed down; with said action resulting in the engagement element of the rocker, which engagement element engages the angled guide of the tension lever, to be able to be moved to a position which is suitable for moving into the front branch of the angled guide of the tension lever.

2. The device according to claim 1, whereby the engagement element of the rocker, said engagement element engaging the angled guide of the tension lever, can also be made to engage the stopping face and the guide means of the slider, whereby the stopping face and the guide means are arranged at the front end region of the slider and are provided so as to connect to each other, and the guide means is arranged between the stopping face and a support surface, and whereby the stopping face is inclined rearwards from the bottom to the top, and the guide means is an indentation which is open towards the front and which extends downward towards the rear at an incline.

3. The device according to claim 1, whereby the rear branch of the angled guide of the tension lever extends more steeply than does the front branch, which is forward inclined.

4. The device according to claim 1, whereby the slider comprises lateral walls which comprise guide slots which form the longitudinal guide which are associated with the lower end region of the rocker; with guide pins of the rocker reaching through said guide slots, with a lace-up traction element being able to be attached to each of said guide pins; and whereby the longitudinal guide of the slider which comprises a front end region inclined upward, comprises an insertion slot which is open towards the top, while the angled guide of the tension lever, in the region of the front branch comprises an insertion slot which is open towards the bottom, for the respectively associated engagement element located on the rocker.

5. The device according to claim 1, whereby the housing comprises guides and end stops (46) associated with the slider, as well as comprising support cheeks flanking the front end region of the lateral walls of the slider, said front end regions comprising the stopping face; and comprises a projecting tongue on which the tension lever is held by means of a snap-in claw which comprises a snap-in recess, with an end stop to prevent detachment, being associated with said snap-in claw, on the tongue.

6. The device according to claim 1, whereby the lace-up traction device comprises a strap encompassing the instep region, with the lace-up traction elements associated with the lower end region of the rocker engaging the lateral ends of said strap; with said lace-up traction elements being push or pull elements, and with an upper end stop being associated with the strap.

7. The device according to claim 1, whereby the housing comprises a snap-in notch associated with the front end region of the rocker, with the spacing between the axle on the housing, said axle being associated with the tension lever, corresponding to the spacing between the snap-in recess of the tension lever, which snap-in recess is associated with the axle, and the lower end region of the insertion slot of the guide groove located on the tension lever.

8. A shoe with a device according to one of the preceding claims.

* * * * *